United States Patent [19]

Lingane et al.

[11] 4,291,920

[45] Sep. 29, 1981

[54] IN SITU EXPLOITATION OF DEEP SET PORPHYRY ORES

[75] Inventors: Peter J. Lingane, Ponca City, Okla.; Michael J. Redman, Belmont, Mass.; Won C. Park, Irvine; Robert A. Hard, Laguna Beach, both of Calif.; Walter W. Harvey, Arlington, Mass.

[73] Assignee: Kennecott Corporation, Stamford, Conn.

[21] Appl. No.: 145,379

[22] Filed: Apr. 30, 1980

[51] Int. Cl.[3] ..... E21B 43/28

[52] U.S. Cl. ..... 299/4

[58] Field of Search ..... 299/4, 5

[56] References Cited

U.S. PATENT DOCUMENTS 3,890,007 6/1975 Heinen et al. ..... 299/4

4,116,488 9/1978 Hsueh et al. ..... 299/4

*Primary Examiner*—Ernest R. Purser

*Attorney, Agent, or Firm*—John L. Sniado; Anthony M. Lorusso

[57] ABSTRACT

Disclosed is a method of economically exploiting deep set porphyry ore bodies of the type containing metal values such as sulfidic copper nickel or uranium minerals and minerals capable of absorbing copper, uranium and nickel ions. The method involves establishing communication with the ore body through access and recovery wells and passing fluids sequentially therethrough. If necessary, thief zones of as low as 25 to 50 md in igneous rock of 1 to 5 md are prevented from distorting flow, by the injection of a polymeric solution of macromolecules with molecular weights of the order of 5 million along the entire wellbore, the higher permeability zones initially accepting the majority of the flow and being impaired at a much faster rate than the less permeable zones.

In a first stage, the permeability of the leaching interval is stimulated as an ammoniated solution of sodium, potassium, or ammonium nitrate or chloride contacts calcium containing minerals to promote ion exchange, resulting in clay contraction or calcium carbonate dissolution. In a second stage, the leaching interval is primed as calcium ion is displaced with an aqueous solution of ammonium salt, a calcium sulfate scale inhibitor, and oxygen gas. In a third stage, a two-phase lixiviant comprising entrained oxygen containing bubbles and an ammoniacal leach liquor having a pH less than 10.5 and less than 1.0 mole/liter ammonia is passed through the leaching interval to solubilize copper, nickel, uranium and other metal values.

6 Claims, 3 Drawing Figures

IN SITU EXPLOITATION OF DEEP SET PORPHYRY ORES

BACKGROUND OF THE INVENTION

This invention relates to a method of exploiting deep set, porphyry ore bodies by in situ mining techniques.

Large deep-lying deposits of copper and nickel in the form of low grade prophyry ores are known to be located throughout various regions of the globe. A porphyry deposit is one in which the copper, nickel or uranium bearing minerals occur in disseminated grains or in veinlets through a large volume of rock such as shist, silicated limestone, or volcanic rock. Acid igneous intrusive rocks are usually in close association. The deposits are typically large tonnage but low grade and have an average copper, nickel and uranium concentration of less than about a 1% total. Minerals found in these deposits are usually sulfides, of these, chalcopyrite is the most common. There are also deep-seated deposits which contain discrete blebs containing copper, copper sulfide, or copper-nickel sulfide in association with ion sulfide. In many ores of this type, significant quantities of zeolites, layered silicates, and clay such as the type known as montmorillonite are present. These minerals are present as deposits located in or about the natural microscopic fracture openings of the rock.

In the method of in-situ mining disclosed in U.S. Pat. No. 4,116,488 to Hsueh et al, an access well is drilled to communicate with the ore body and several recovery wells are provided, spaced apart from the access well. The leaching interval, i.e., the volume of rock through which leaching fluids flow between the access and recovery wells, is then subjected to fluids such as oxygen which oxidize the copper and nickel sulfides or chalcopyrite to sulfates. Thereafter, or in some cases simultaneously, an aqueous ammoniacal leach liquor is injected into the access well which, in passing through the leaching interval and contacting the metal sulfates, leaches the metal values as nickel and copper-ammonia complex ions. The leaching fluids may be injected in the form of a two-phase lixiviant, i.e., oxygen bubbles dispersed in an ammoniacal leach liquor, or may be passed sequentially through the leaching interval. One advantage of this technique is that the rock need not be fractured by explosive methods prior to leaching. Instead, the fluids used are forced through the natural fracture openings present in the rock, which typically range in the diameter between about 30 and 300 microns.

For the most efficient use of the lixiviant, it should pass rather uniformly through the leaching interval, so that its potency is not squandered on a few highly permeable passages. Igneous rock does have permeability variations, however, that cause non-uniform flow of the lixiviant through the leaching interval.

An igneous rock deposit having a permeability of 1 to 5 md may be economically mined by the in-situ method, but in such a deposit rock zones having a permeability of 25 to 50 md represent thief zones-zones of relatively high permeability that accept inordinately high amounts of lixiviant to the detriment of the over-all efficient use of the lixiviant in the process.

One technique that has been used in the petroleum industry to smooth flow involves impairing thief zones with solid particles, so that they cannot accept lixiviant so readily. However, utilizing solid particles small enough to fit into the pores of rock having a permeability of 25 to 50 md is not practical.

Furthermore, when the wellbore injection interval is several thousand feet, it can be very time-consuming and expensive to use a preliminary liquid solution to separately treat short intervals of variable permeability.

During such in situ mining efforts, the presence of clays, zeolites, and layered silicates in or about the fracture openings present problems which heretofore significantly diminished the economic feasibility of this type of process. Such minerals absorb copper and nickel as well as other ions such as uranium ions by ion exchange and are capable of taking up as much as 1.5 milliequivalents of copper per gram of ion exchanger. In practice, this uptake of metal represents perhaps as much as 25% of the total metal leached, and thus leads to significantly reduced metal recoveries. It has been discovered that the copper, nickel and uranium ions are sorbed by an in situ ion exchange process wherein calcium or other ions naturally present in the mineral are exchanged for copper, nickel or uranium ions or ammonia complexed ions such as $Cu(NH_3)_4^{++}$ or $Cu(NH_3)_3OH^+$. The presence of the clays, e.g., montmorillonite clays, such as Fuller's earth and bentonite, and other absorptive minerals thus cause the uptake of significant quantities of solubilized metal values which would otherwise be recoverable.

In addition to this complication, the presence of these minerals seriously inhibits the rate at which leach liquors may be pumped through a leaching interval during in-situ mining. Also, calcium and other ions are introduced into the lixiviant thereby complicating copper, nickel and uranium recovery at the surface plant. Obviously, whether such deposits can be economically exploited hinges on whether methods can be devised which maximize metal yield, minimize reagent costs, and overcome the problems set forth above.

SUMMARY OF THE INVENTION

The invention provides a staged process for recovering copper, nickel and uranium from deep-set (typically below 1000 feet in depth) porphyry ore bodies utilizing in situ techniques. The process involves five distinct stages: thief zone plugging; permeability stimulation; priming; a steady-state metal recovery stage; and a termination stage. Each stage of the process is designed to deal with the rather unique problems associated with the type of ore body discussed above. Advantageously, no rubblization step wherein the ore is fractured by explosives is required but, of course, may be used if desired.

At the outset, an injection well and, typically, several recovery wells are drilled to provide communication between the surface of the earth and the ore body. The volume of rock between the injection well and the recovery wells defines the leaching interval. To reduce thief zones, a polymeric solution is injected along the entire wellbore of the injection well. The solution contains macromolecules with molecular weights in the order of 5 million. The polymeric solution may be introduced along with the lixiviant.

In the next stage of the process, the permeability of the leaching interval is stimulated by passing an aqueous solution of ammonia and a chloride or preferably a nitrate salt of sodium, potassium, and/or ammonium therethrough. The purpose of this stage is to ion exchange $Na^+$, $K^+$, or $NH_4^+$ ions for $Ca^{+2}$ ions in the clay and other minerals in the ore to produce a more compact structure and to increase the void volume of the natural rock fractures present in leaching interval. Usually, $Ca^{++}$ is the displaced ion. Nitrate is the preferred anion because $Ca(NO_3)_2$ is highly water soluble, and as such, can be removed, thereby permanently increasing the permeability of the leaching interval.

In the next stage, the leaching interval is primed with an oxygen containing gas and an ammonium salt solution containing a calcium sulfate scale inhibitor. This stage flushes calcium ions from the leaching interval which may be removed in a surface facility. A relatively high $NH_4^+$ concentration is maintained so that minerals present in the leaching interval which can absorb copper, nickel and uranium ions instead take up ammonium ions. The oxygen containing gas oxidizes the copper, nickel or uranium sulfides or iron sulfides to render the metal values leachable. The oxidation also results in the formation of sulfate, and to this end a scale inhibitor such as a polyacrylate inhibitor, Calnox® 214, or other known scale inhibitor is included in the priming fluids to inhibit the deposition of calcium sulfate phases.

In the steady state metal recovery stage a two-phase lixiviant is passed through the leaching interval. The lixiviant is designed so that copper, nickel, uranium and other ions are liberated from the ore and then solubilized in the aqueous phase. The nature and concentration of the reagents in the aqueous phase are selected so that a pH low enough to avoid zeolite formation is maintained and metal absorption is kept at a minimum. Under these circumstances, a scale inhibitor is no longer needed. Copper, nickel and uranium (or other metals such as cobalt and molybdenum) are recovered by conventional techniques from the pregnant liquor collected from the production well, and the metal barren raffinate may be reconstituted and reinjected.

In the last stage of the process, a filler solution such as 5% brine is injected into the leaching interval to displace the last of the valuable ammonia and metal value solution.

Accordingly, it is an object of the invention to provide a method for producing more uniform flow of lixiviant through a leaching interval of varying permeability.

Another object of the invention to provide a process for increasing the permeability of porphyry rock of the type containing clays having cations available for ion exchange.

Another object of the invention is to contract calcium montmorillonite clay, in-situ, by ion exchange using ammonium ions, potassium ions, sodium ions, or mixtures thereof, and to shrink or contract sodium montmorillonite by contacting it with ammonium ions, potassium ions, or mixtures thereof.

Another object of the invention is to decrease the characteristic resistance to fluid flow of porphyry rock ore bodies containing clays.

Yet other objects of the invention are to decrease metal uptake by minerals present in ore bodies capable of undergoing ion exchange with copper, nickel or uranium and to provide a procedure whereby the amount of copper, nickel or uranium recoverable from an ore body by in-situ mining techniques may be increased.

Still another object of the invention is to provide a process for in-situ mining of copper, nickel, cobalt, molybdenum and uranium wherein the concentration of metal values in the pregnant solution recovered is more or less uniform throughout the duration of a steady-state metal recovery stage.

Another object is to increase the yield per unit cost in in situ mining of metal such as copper, nickel, cobalt, molybdenum and uranium.

These and other objects and features of the invention will be apparent to those skilled in the art from the following description of some preferred embodiments and from the drawing.

DESCRIPTION OF THE PREFERRED EMBODIMENTS

Figure 1:
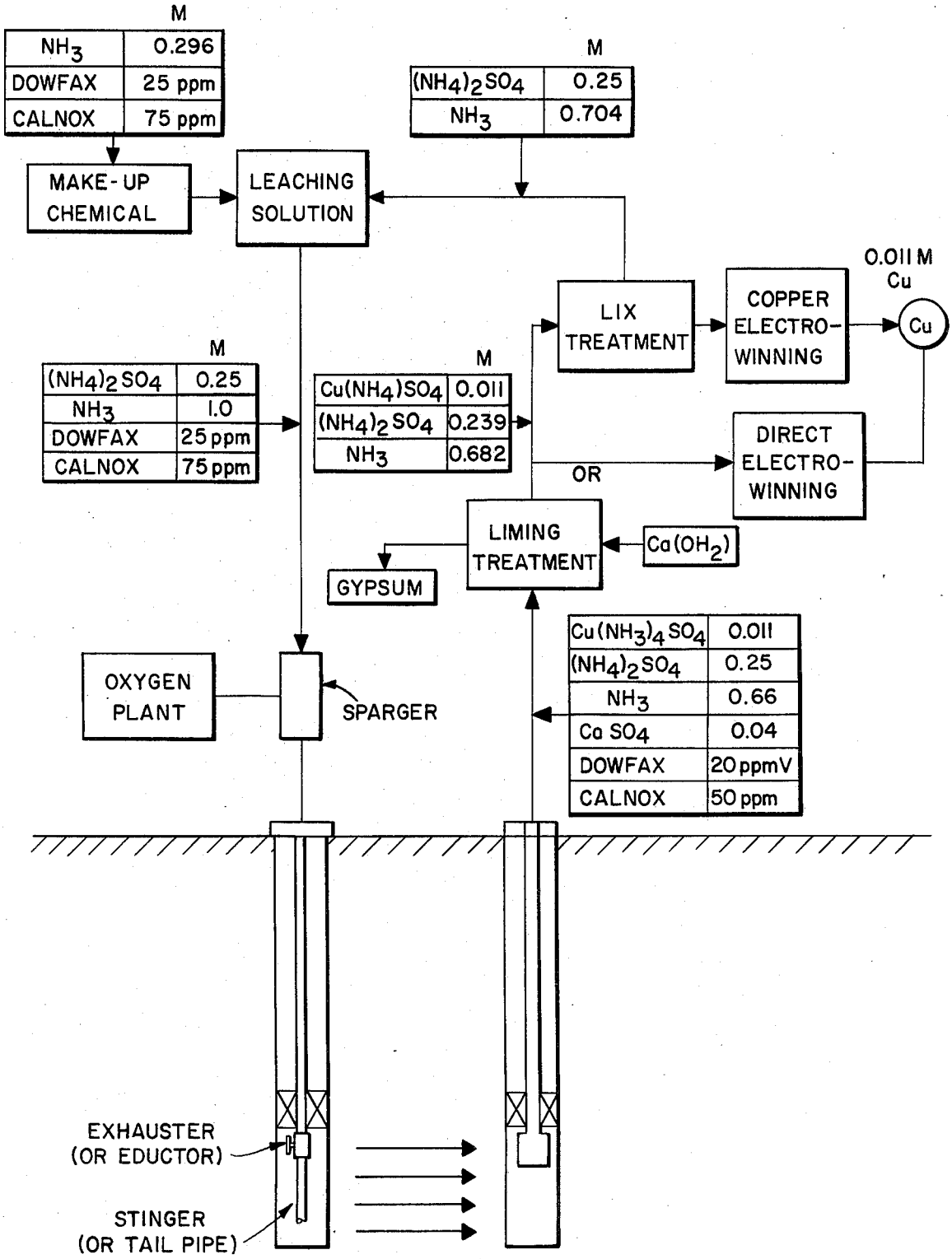
FIG. 1 illustrates the operation of an in situ mine during the steady-state metal recovery stage of the invention.

The process of the invention is useful in exploiting porphyry ore deposits containing sulfidic copper, nickel, cobalt, molybdenum, uranium and other metal values. These are permeated by a multiplicity of natural fracture openings which provide a pathway through which leaching or other fluids may be forced under hydraulic pressure. In or about the fracture openings, copper nickel and uranium containing minerals such as chalcopyrite, chalcocite, diginite, covellite, pentlandite, heazlewoodite, vaesite, and violarite are present. Unfortunately, these deposits are also characterized by the presence of clays such as bentonites and montmorillonites, naturally occurring zeolites such as stilbite and laumontite, clinoptilolite, and other minerals or biotites and sericites. An example of such a deposit is the ore body located near Safford, Ariz., and is known as Safford rock. The clay, zeolite and biotite components of Safford rock take up copper in the ammine form and in the process become purple. Estimates from ore samples of the clay content of such rock ranges up to about 5%, but averages 1% to 2%. These and other clay-like minerals found in the porphyry formations present unique problems of permeability and loss of reagent and/or metal ion product.

In accordance with the invention, one or more access wells and one or more recovery wells are provided to the ore body. The volume between the access well and recovery wells defines a leaching interval. Typically, a plurality of access wells and recovery wells are drilled in a five-spot pattern wherein each access well is surrounded by four recovery wells. Core samples are taken from the ore body, and these are used to determine optiminum reagent concentrations for the various stages of exploitation as set forth below. If desired, thief zones may be plugged with macromolecules although this step is optional. In the next stage, the permeability of the leaching interval is stimulated and the deposit is preconditioned with scale inhibitor. In a following stage, the leaching interval is primed. In another stage, metal bearing pregnant liquor is recovered over an extended period wherein conditions in the leaching interval are in steady state, and in a fourth stage, a filler solution containing inexpensive reagents is used to displace the last of the valuable in situ solutions. These steps are effected by forcing the various fluids through the leaching interval under pressure. Equipment suitable for use in the process is disclosed, for example, in U.S. Pat. No. 4,116,488, Sept. 26, 1978, to Hsueh et al., the disclosure of which is incorporated herein by reference. Each stage of the process will now be discussed in detail.

Thief Zone Plugging

As stated above, high permeability thief zones may be plugged with macromolecules in order to even out the permeability of the leaching interval. This step may be performed as a first step or may be performed along with the addition of the lixiviant. Of course, if high permeability thief zones are not a problem, then this step may be eliminated completely. A macromolecule that is suitable for plugging high permeability thief zones is one sold by Dow Chemical under their designation DOWELL J-250. This is a polyacrylamide solution. This solution is employed to plug pores with sizes ranging from 0.025 to 14 microns. The molecular weight of the polyacrylamide is about 7 million.

This solution should be utilized in a system having a pH within the range of 7 to 11. The pH of the normal ammoniacal lixiviant used in in-situ mining is around 10. At this point, it should be noted that the use of such macromolecules to plug high permeability thief zones is a technique which has been utilized in the petroleum industry; and thus, forms no part of the invention per se.

Permeability Stimulation

Porphyry rock ore bodies frequently contain inorganic ion exchangers of high exchange capacity (approximately 100–150 meq per 100 grams). It has been discovered that certain of these exchangers, notably montmorillonite clays, may be transformed to a more compact structure if they are treated with certain ions capable of exchanging with the cations naturally present in the clays, typically calcium. As a result of such treatment, the natural resistance to fluid flow of the porphyry ore bodies is significantly decreased, and the rate at which in-situ mining procedures may be conducted increased, i.e., the rate at which fluids may be passed through the leaching interval is increased. An aqueous solution containing a cation such as ammonium, potassium, or sodium, contacts the leaching interval through the injection well, and the cations of the solution are exchanged with the sodium or calcium cations in the clay to induce clay contraction. The preferred anion is nitrate, although chlorides may also be used. Use of nitrate salts results in the solubilization of liberated calcium, which may be removed from the solutions initially collected from the recovery wells.

The basic concept of the stimulation stage of the process is to replace one type of ion in the clay with another to induce clay contraction. Thus, if, as in the typical case, the clay contains a significant amount of calcium ion, then sodium, potassium, or ammonium ions are used to displace the calcium ions and thereby to contract the clay. It has been found that potassium ions and ammonium ions produce about the same effect; thus, either of these ions may be used to replace calcium ions and sodium ions. Of course, ammonium ions are preferred because of their lower molar cost.

As a result of permeability stimulation procedures such as those described above, the rate at which fluids can be pumped into a leaching interval at a given surface pressure is significantly increased, often about seven fold.

Numerous tests have been conducted to determine the effect of injecting aqueous solutions containing various cations into porphyry ore bodies, and a variety of clays have been subjected to X-ray diffraction procedures to determine their lattice spacings before and after treatment with various ion exchange solutions. These tests have shown, inter alia, that ammonia, if present in the solution used to stimulate permeability, potentials the in situ ion exchange reaction. Calcium ion is released in most instances. Since a certain amount of sulfate ion will be naturally present in the porphyry rock, it is often advantageous to include a scale inhibitor in the solution, e.g., at a concentration on the order of 400 ppm, to inhibit the deposition of calcium sulfate phases as anhydrite, bassenite and gypsum in the deposit and production equipment.

The permeability stimulation stage will be further understood from the following non-limiting examples.

EXAMPLE I

Samples of bentonite, a natural montmorillonite, were obtained from the American Colloid Company, and their structure was verified by comparing their X-ray diffraction spectra with authentic samples of natural bentonite obtained from core samples of a porphyry rock ore body located near Safford, Ariz. These samples were slurried with test ion exchange solutions at room temperature, filtered, and their basal spacing was determined using an X-ray diffractometer. The results of these experiments are summarized in Table I.

TABLE I

Relative Volume of Montmorillonites at Room Temperature

| | d(001), AU | Relative Volume |
|---|---|---|
| $Ca^{++}$ -montmorillonite | 18.3 ± 0.3 | 100 |
| $H^{+}$ -montmorillonite | 16.1 ± 0.2 | 86 |
| $Na^{+}$ -montmorillonite | 15.77 | 84 |
| $K^{+}$ -montmorillonite | 13.27 | 71 |
| $NH_4^{+}$ -montmorillonite/3M $NH_3$ | 12.66 | 69 |

As indicated by the data in Table I, the basal spacing of the montmorillonite is strongly dependent on the composition of the fluid with which it is equilibrated. The exact origin of this effect is unknown, although it is hypothsized that it is due to ion exchange substitution. Alternatively, the behavior may be caused by alteration of the degree of hydration of the clays with different cation substitutions. As can be seen from the data in Table I, the lattice spacing of Ca-montmorillonite is greater than that of the other cation-substituted montmorillonites tested. Because much of the montmorillonite clay naturally present in prophyry rocks of the type described is in the calcium form, significant increases in permeability may be effected by ion exchange with hydrogen, sodium, potassium, or ammonium cations, the latter being present together with $NH_3$. However, because of the presence of acid consuming minerals such as calcite in the ore body, acid solutions cannot be economically employed. When the clay is present in the sodium form, the addition of an aqueous solution containing sodium ions will, of course, have no effect on the volume of the clay. A solution containing calcium ions will actually swell the clay and increase resistance to fluid flow through the ore body. Accordingly, potassium or ammonium ions must be used to accomplish the desired effect when (if ever) sodium clays are the only type present.

EXAMPLE II

The effects of equilibrating ammonium salts and aqueous ammonia with calcium montmorillonite are set forth in Table II. The calcium montmorillonite was obtained by suspending bentonite in a 10% aqueous solution of $CaCl_2$ for several days, resulting in calcium ions exchanging for the sodium ions present. The calcium clays produced in this manner were suspended in the various solutions set forth below to effect equilibration, and the lattice spacings of the species formed were measured.

TABLE II

Ion Exchange Effects on Ca-Montmorillonite

| Sample | d(100), of Species (AU) | Amount of Species Produced (%) | Volume Decrease (%) |
|---|---|---|---|
| 1. Untreated Ca montmorillonite | 18.8 | (100) | — |
| 2. a. 3M $NH_4Cl$ | 15.4 | 90 | 20 |
| | 12.6 | 10 | — |
| b. 3M $NH_4Cl$/1M $NH_3$ | 15.5 | 76 | 21 |
| | 12.6 | 24 | |
| c. 3M $NH_4Cl$/6M $NH_3$ | 12.6 | 100 | 33 |
| 3. a. 1.5M $(NH_4)_2SO_4$ | 15.4 | 88 | 20 |
| | 12.6 | 12 | |
| b. 1.5M $(NH_4)_2SO_4$/1M NH(3) | 15.4 | 68 | 23 |
| | 12.6 | 32 | |
| c. 1.5M $(NH_4)_2SO_4$/6M $NH_3$ | 12.6 | 100 | 33 |
| 4. a. 3M $NH_4NO_3$ | 15.7 | 100 | 17 |
| b. 3M $NH_4NO_3$/1M $NH_3$ | 15.5 | 76 | 21 |
| | 12.6 | 24 | |
| 5. a. 1M $NH_3$ | 19.2 | 91 | 2 |
| | 15.6 | 9 | |
| b. 3M $NH_3$ | 15.6 | 100 | 17 |
| c. 6M $NH_3$ | 15.6 | 100 | 17 |

As can be seen from the data in Table II, equilibrating the Ca-clay with ammonium salts produced two separate species of montmorillonite: one having about a 15.5 AU basal spacing, the other having a much smaller 12.6 AU spacing. Only the 15.5 A species was produced by $NH_4NO_3$, and the 15.5 AU species was the predominant one produced by pure $NH_4Cl$ and $(NH_4)_2SO_4$ salts. This 15.5 AU species can also be produced by equilibrating the calcium clay with 3–6 M ammonia (samples 5 a, b, and c). Advantageously, as can be seen from the data, solutions containing both ammonia and ammonium salts tend to increase the amount of the 12.6 AU species produced. As the concentration of the ammonia approaches 6 M, there is a tendency for the clay to be converted to the 12.6 AU species, and a volume decrease approaching 33% is produced. This example illustrates the potentiating effect observed when $NH_3$ is combined with an ammonium salt.

EXAMPLE III

The ion exchange effects of equilibrating sodium montmorillonite with various ammonium salts is illustrated in Table III as set forth below. The data in this example were collected in the manner set forth in Example II, except that Na-montmorillonite was used as a starting material.

TABLE III

Ion Exchange Effects on Na-Montmorillonite

| Sample | d(001), Au of species | Amount of Species (90%) | Volume Decrease (%) |
|---|---|---|---|
| Na-Montmorillonite, untreated | 15.8 | (100) | — |
| Na-Montmorillonite equilibrated with: | | | |
| 1. a. 2M $NH_4NO_3$/0.1M $NH_3$ | 15.1 | 62 | 10 |
| | 12.7 | 38 | |
| b. $H_2O$ | 15.4 | 70 | 6 |
| | 12.5 | 30 | |
| 2. a. 3M $NH_4NO_3$/0.1M $NH_3$ | 13.8 | 51 | 16 |
| | 12.7 | 49 | |
| b. 3M $NH_4NO_3$/1M $NH_3$ | 12.6 | 100 | 20 |
| 3. 2M $NH_4NO_3$/1M $NH_3$ | 12.9 | 100 | 18 |
| 4 a. 1.5M$(NH_4)_2SO_4$ | 15.4 | 94 | 3 |
| b. 1.5M$(NH_4)_2SO_4$/1M $NH_3$ | 15.5 | 72 | 7 |
| | 12.6 | 28 | |
| c. 1.5M$(NH_4)_2SO_4$/6M $NH_3$ | 12.6 | 100 | 20 |
| 5. 1M $NH_3$ | 15.6 | 50 | 11 |
| | 12.6 | 50 | |

As can be seen from the data in Table III, ammonia alone causes an 11% decrease in the volume of the sodium clay and produces about equal amounts of the two species. The sodium clay can be completely converted to the 12.6 A species in ammoniacal ammonium nitrate, ammonium sulfate, or ammonium chloride solutions. (see 2b and 4c).

EXAMPLE IV

The data in Table IV, as set forth below, were obtained by sequentially equilibrating bentonite samples with the indicated solutions for about one hour each. These data illustrate that the changes in the basal spacing of the clay are reversible.

TABLE IV

Demonstration of Reversibility of Change in Basal Spacing of Bentonite

| Sequence | | Solution | d(001), Au |
|---|---|---|---|
| Sample 1 | a | 1M $NH_3$/3M $NH_4NO_3$ | 12.58 |
| | b | 10% KCl | 13.38 |
| | c | 1M $NH_3$/3M $NH_4NO_3$ | 12.62 |
| | d | 10% KCl | 13.10 |
| Sample 2 | a | 10% $CaCl_2$ | 18.67 |
| | b | 1M $NH_3$/3M $NH_4NO_3$ | 12.73 |
| | c | 10% $CaCl_2$ | 18.43 |
| | d | 1M $NH_3$/3M $NH_4NO_3$ | 12.80 |
| Sample 3 | a | 1M $NH_3$/3M $NH_4NO_3$ | 12.62 |
| | b | 10% NaCl | 15.77 |
| | c | 1M $NH_3$/3M $NH_4NO_3$ | 12.62 |
| | d | 10% NaCl | 15.77 |
| Sample 4 | a | 1M $H_2SO_4$ | 18.95 |
| | b | 3M $NH_4NH_3$/1M $NH_3$ | 12.99 |
| | c | 1M $H_2SO_4$ | 15.85 |
| | d | 3M $NH_4NH_3$/1M $NH_3$ | 12.86 |
| | e | 1M $H_2SO_4$ | 15.82 |
| Sample 5 | a | 10% $(NH_4)_2SO_4$ | 15.52 |
| | b | 10% HCl | 16.05 |
| | c | 10% $(NH_4)_2SO_4$ | 15.74 |

From the data disclosed above, there is a suggestion that the prehistory of a calcium clay may influence the ease with which the basal spacing can be changed. For example, the calcium clays in Table II were prepared by treating bentonite with calcium chloride for several days, and a solution comprising 3 M $NH_4^+$ and about 6 M $NH_3$ was required to completely convert this clay to the 12.6 A species. On the other hand, the calcium clays of Table IV were prepared by treating bentonite with calcium chloride for a period of only one hour. This material could be completely converted to 12.6 A species by treatment with 3 M $NH_4^+$ solution containing only 1 M $NH_3$. Accordingly, the optimum concentration of the ion exchange solution should be determined from core samples prior to injection.

EXAMPLE V

The effects of miscellaneous additional solutions on bentonite are summarized in Table V set forth below. It should be noted that acidic cupric solutions produce a basal spacing slightly greater than that of the naturally occuring calcium clay. In any event, acidic reagents cannot be economically employed to leach the metal values because of the presence of acid consuming minerals in these formations. It can be further seen from Table V that acids such as are used to stimulate oil wells are not effective for increasing the permeability of the ore bodies of the type disclosed, especially those containing the sodium form of the montmorillonite clay. Ammoniacal cupric solutions (sample 3) are absorbed and collapse the clay almost as much as ammoniacal ammonium salt solutions. This observation is an important consideration in the subsequent priming stage described below.

TABLE V

Effect of Various Equilibration Solutions on the Specific Volume of Bentonite

| Sample | | Solution | d(001), AU |
|---|---|---|---|
| 1. | Bentonite | 1M $CuCl_2$/1gpl HCl | 19.4 |
| 2. | Bentonite | 1M $Cu(NO_3)$/Trace $HNO_3$ | 19.3 |
| 3. | Bentonite | 0.03M $CuSO_4$/1M $NH_3$ | 13.18 |
| 4. | Bentonite | 6 gpl Fe/7gpl Al/4 gpl Mg as sulfates pH = 2 | 19.9 |
| 5. | Bentonite | 10% $CaCl_2$ | 18.9 |
| 6. | Bentonite | 10% KCl | 13.3 |
| 7. | Bentonite | 10% HCl | 16.1 |
| 8. | Bentonite | 1M $H_2SO_4$ | 15.9 |
| 9. | Bentonite | untreated | 15.8 |

From the foregoing, it can be appreciated that $Na^+$, $K^+$, and $NH_4^+$ solutions, especially when potentiated by the presence of $NH_3$, are effective in increasing the permeability of porphyry ore bodies. If the anion in these solutions is nitrate or chloride, the released $Ca^{++}$ ion will be solubilized, and can be removed at the surface plant by conventional techniques.

Priming Stage

The purpose of the priming stage is to begin the release of copper, nickel, cobalt, molybdenum, uranium and other metals from the porphyry ore and to suppress the uptake of these metal values by the ion absorbing clays and other minerals present in the leaching interval discussed above.

In accordance with the invention, it has been discovered that ammonium ions present in ammonium salt solutions can be induced to be taken up by metal absorbing minerals preferentially to copper, nickel, uranium and other metal ions. Therefore, it is possible to suppress metal uptake by subjecting the leaching interval to treatment with an ammonium ion containing solution, preferably of high concentration, to saturate the absorption sites. This step, in cooperation with the steady-state metal recovery step set forth below, significantly increases yield.

Thus, oxygen gas, a scale inhibitor, and an aqueous solution containing an ammonium salt, e.g., $(NH_4)_2SO_4$, $NH_4NO_3$, or $NH_4Cl$, is pumped through an access wall into the leaching interval and forced into contact with the clay minerals. It has been determined by experiment that ion exchange is effected rapidly and that various concentrations of the ammonium ion, ranging generally between about 0.2 M and about 7 M, but preferably at least about 1.0 M, are effective to inhibit uptake of metal ions by the clays. The preferred concentration of ammonium ions is 3 M. During this process, only minimal amounts of metal ions are leached since ammonia is not available in abundance for complexing. A calcium rich solution is displaced from the leaching interval. To inhibit the precipitation of one of the many forms of calcium sulfate, a scale inhibitor such as a polyacrylate is included in the solution. One suitable scale inhibitor has a molecular weight of 250 to 10,000 and has an equivalent weight of 150 or less. A suitable polyacrylate scale inhibitor is one sold by Aquaness Chemical Company under the trade name CALNOX® 214. At the outset, inhibitor concentrations in the injected fluids on the order of 400 ppm are required. Thereafter, concentrations can be reduced to maintain on the order of 5–50 ppm in the produced fluids. Subsequently, in the steady state metal recovery stage, a two phase lixiviant comprising oxygen bubbles and an ammoniacal leach liquor or a quantity of oxygen followed by an ammoniacal leach liquor is injected into the leaching interval. In this situation, even the first samples of pregnant liquor recovered during the steadystate stage contain a concentration of copper, nickel and uranium which is normally characteristic of samples taken much later in the leach.

Suppression of metal exchange on montmorillonite clays by the process of the invention renders the rock capable of holding only about 0.01% Cu (20 lb/ton rock) as an exchanged species in contrast to the 0.1% Cu uptake of untreated rock.

To optimize the effect of this procedure, the length of the priming stage may be estimated by percolating a solution of 0.25 M $(NH_4)_2SO_4$, 0.6 M $NH_3$, and 0.05 M $CuSO_4$ through a column containing 300 g of minus five mesh crushed core samples characteristic of the leaching interval. The amount of copper sorbed (tons copper/million tons of ore), if divided by twice the projected copper production rate (tons copper/year/million tons of ore) results in a useful estimated length of the priming period. The ammonium ion concentration required may be estimated by measuring the amount of ammonium sorbed per unit mass of ore during the percolation experiment and distributing one-half of this amount, extrapolated to be required by the total mass of the leaching interval, uniformly through the entire volume of solution injected during priming. This volume may be estimated as the product of the injection rate and the estimated length of the priming period. In an appropriate case, ammonia may be included in the priming solution near the end of the priming period to aid in the solubilization of metal values. A typical ammonium ion concentration for use in priming is 3–6 M. The pH of the ammonia containing solution should be maintained below a pH of around 10.2. Above this pH mineral alteration takes place with the production of zeolite-like minerals capable of removing copper and other metals from solution as illustrated in Example VI.

EXAMPLE VI

Effect of high pH upon the formation of copper containing zealite-like minerals.

Rock cubes from the deposit were treated with 3 M $NH_6OH$-0.14 M $(NH_4)_2SO_4$ at 90° C. and 1850 psi $O_2$ for 3–5 months. On opening the autoclave, a blue deposit had formed on the cube surfaces and also upon the autoclave walls. This phase was shown by chemical analysis to contain copper and shown by X-ray diffraction to resemble the natural zeolite known as phillipsite. Thus, a portion of the leached copper had been reprecipitated and thus became unobtainable.

One way of controlling the pH is to ensure an ammonium ion concentration of at least 0.5 M and preferably of at least 1 M.

Keeping the ammonia level to below 1 M also contributes in keeping the pH value down to below 10.2.

A large number of experiments have been conducted in order to demonstrate the feasibility of this stage of the process of the invention. One of the materials used in these experiments was air purified montmorillonite obtained from American Colloid Company, the exchangeable ion in this material being predominantly sodium. The exchangeable ion in many naturally occurring montmorillonites is predominantly calcium with minor amounts of potassium. However, as noted above, it has been observed that the sodium species is readily converted into the calcium or potassium species, and that this conversion may be reversed by equilibrating the montmorillonite in salt solutions containing the desired ion. In other experiments, various authentic ore samples were tested. As a general rule, the ion exchange process on montmorillonites, either as naturally present in the rock or purified, is quite rapid, only a few minutes being needed for attainment of equilibrium. However, in all experiments, equilibrium was assured by at least a 24 hour exposure to the various solutions.

EXAMPLE VII

Comparison of Cu Uptake on Porphyry Rock Samples 60 grams of 8–12 mm fragments of several types of rock known to be present in porphyry ore bodies were subjected to equilibration with 25 ml aqueous solutions containing 1 M $NH_3$, 0.5 M $(NH_4)_2SO_4$, and either 4 gpl or 1 gpl solubilized copper. The duration of the treatment and the temperature maintained were varied. The results of these experiments, expressed as milliequivalents (meg) of copper removed from solution per 100 g of rock, are set forth below in Table VII.

TABLE VII

| | Time at Temperature | Copper Uptake (meq/100 g) | | | |
|---|---|---|---|---|---|
| | | 4 gpl copper | | 1 gpl copper | |
| Rock Sample | (days) | 90° C. | 50° C. | 90° C. | 50° C. |
| Safford, Arizona | 6 | 1.36 | 1.40 | 0.74 | 0.52 |
| (Andesite) | 14 | | 1.40 | 0.85 | 0.52 |
| Ray, Arizona | 4 | 2.30 | 2.10 | 0.91 | 0.75 |
| (Diabase) | 11 | 2.60 | 2.50 | 0.96 | 0.87 |
| | | 75° C. | | 75° C. | |
| Bingham, Utah | 4 | 1.51 | | 0.66 | |
| (Biotite-Granite) | 18 | 1.76 | | 0.93 | |
| | 43 | 1.76 | | | |

As can be seen from the data in Table VII, copper uptake from ammoniacal solution is a general characteristic of copper porphyry rock fragments. Uptake varies with cupric ion concentration. Temperature dependency is not apparent from the 4 gpl data, but is evident from the 1 gpl data. A small increase in copper uptake with temperature could be due to increased interaction between chalcopyrite and cupric solutions.

EXAMPLE VIII

Effect of $[NH_4^+]$ on Copper Uptake On Clay

Two gram samples of air purified bentonite were equilibrated at 25° C. with 20 ml 1 M $NH_4OH$ initially containing 2 gpl Cu and varying concentrations of $NH_4NO_3$. The amount of copper taken up by the clay is set forth in Table VIII. It is evident that copper loss from solution decreases with increasing ammonium ion concentration.

TABLE VIII

| Ammonium Ion Concentration (M) | Copper Uptake (Meq/100 g) |
|---|---|
| 0 | 141 |
| 0.33 | 69 |
| 1 | 37 |
| 2 | 18 |
| 3 | 10 |
| 4 | 7 |
| 5 | 3.5 |

EXAMPLE IX

Effect of $[NH_4^+]$ on Copper Uptake on Rock 50 gram samples of 8–12 mm fragments of Safford Rock were equilibrated for 6 days at 75° C. with 25 ml of various aqueous solutions. Initially, each solution contained 1 gpl copper. The amount of copper taken up by the rock samples is set forth in Table IX below.

TABLE IX

| Solution Composition | Copper Uptake (meq/100 g) |
|---|---|
| 1M $NH_3$ | 1.29 |
| 1M $NH_3$—0.5M $(NH_4)_2SO_4$ | 0.53 |
| 1M $NH_3$—1.0M $NH_4NO_3$ | 0.64 |
| 1M $NH_3$—2M $(NH_4)_2SO_4$ | 0.04 |
| 1M $NH_3$—2.6M $NH_4NO_3$ | 0.11 |
| 1M $NH_3$—1.3M $NH_4NO_3$—0.6M $(NH_4)_2SO_4$ | 0.14 |
| 3M $NH_3$—1M $(NH_4)_2SO_4$ | 0.09 |

EXAMPLE X

The procedure of Example IX was repeated except that 30 g samples of 4–8 mm fragments of a different Safford Rock ore sample were equilibrated with 15 ml solution for 4 days, the original solutions containing 2 gpl copper. The results of this experiment are set forth in Table X below.

TABLE X

| Solution Composition | | Copper Uptake (meq/100 g) |
|---|---|---|
| $NH_3$ (M) | $NH_4NO_3$ (M) | |
| 1 | 0 | 0.9 |
| 1 | 1 | 0.57 |
| 1 | 2 | 0.25 |
| 1 | 3 | 0.13 |
| 1 | 4 | 0.06 |
| 2 | 1 | 0.28 |
| 2 | 2 | 0.28 |
| 2 | 3 | 0.14 |
| 2 | 4 | 0.20 |
| 3 | 1 | 0.25 |
| 3 | 2 | 0.20 |
| 3 | 3 | <0.04 |
| 4 | 1 | 0.42 |
| 4 | 2 | 0.16 |

The data in the above two tables clearly demonstrate that Cu uptake decreases with increasing ammonium ion concentration and also decreases, but to a much smaller extent, with increased ammonia concentration. Further, it is apparent from the above that the copper uptake suppression phenomenon is independent of the anion used.

EXAMPLE XI

Effect of Other Cations on Copper Uptake by Rock

Solutions were prepared containing 1 M $NH_3$, 0.5 M $(NH_4)_2SO_4$, and various other cations as indicated below. Twenty-five ml aliquots of these solutions were then added to 50 grams of 8–12 mm fragments of Safford Rock and equilibrated for 6 days at 75° C. Copper uptake data are set forth in Table XI.

TABLE XI

| Solution Composition 1M $NH_3$—0.5M $(NH_4)_2SO_4$ plus | Copper Uptake (meq/100 g) |
|---|---|
| 0.5M $(NH_4)_2SO_4$—2 gpl Cu | 0.12 |
| 0.4M $Na_4So_4$—2 gpl Cu | 0.31 |
| 1.0M $MgSO_4$—2 gpl Cu | 0.28 |
| 0.5M $K_2SO_4$—2 gpl Cu | 0.19 |
| 0.33M $MgSO_4$—4 gpl Cu | 0.87 |
| 1 gpl $Zn^{++}$—2 gpl Cu | 0.49 |

From these data it is apparent that other cations are less effective than ammonium ion in suppressing copper uptake.

EXAMPLE XII

Effect of $[NH_4^+]$ on Nickel Uptake By Clay 4 gram samples of montmorillonite were equilibrated at 25° C. with 50 ml of ammoniacal solution containing 0.1 gpl nickel. The results, Table XII, show that less nickel is taken up at higher ammonium ion concentrations.

TABLE XII

| $NH_3$ | $NH_4NO_3$ | Final Ni Concentration |
|---|---|---|
| M | M | gpl |
| 0.2 | 0.5 | 0.026 |
| 1 | 3 | 0.099 |

EXAMPLE XIII

Effect of $[NH_4^+]$ on Nickel Uptake on Rock 30 gram samples of crushed porphyry rock were treated for 7 days at 75° C. with 15 ml of ammoniacal solution containing 0.02 gpl nickel. It is seen, Table XIII, that less nickel is lost to the rock at the higher ammonium level.

TABLE XIII

| $NH_3$ | $NH_4NO_3$ | Final Ni Concentration |
|---|---|---|
| (M) | (M) | (gpl) |
| 0.2 | 0.5 | 0.007 |
| 1 | 3 | 0.020 |

Losses of other metals such as uranium, cobalt and molybdenum are also reduced by preventing uptake of these metals by clays.

Steady State Stage

At the beginning of this stage of the process of the invention, the leaching interval contains a solution containing calcium, some metal values, an ammonium salt, and (optionally) some ammonia. The clay has been contracted, and ammonium ions have been absorbed into the absorption sites of the copper, nickel, cobalt, molybdenum and uranium absorbing minerals. A portion of the metal sulfides has been oxidized by the injection of oxygen gas in the priming stage, and the leaching interval is accordingly ready for productive metal leaching.

Broadly, leaching is effected by forcing a two-phase lixiviant comprising an aqueous ammoniacal solution containing a stabilizing surfactant and minute oxygen gas containing bubbles into the leaching interval by means of a sparger located, for example, in the access well bore at the level of the leaching interval or at the surface plant. Apparatus for effecting this process and further particulars on the lixiviant are disclosed in the aforementioned U.S. Patent No. 4,116,488 to Hsueh et al. and in U.S. Pat. No. 4,045,084, the disclosures of which are incorporated herein by reference.

Briefly, the aqueous phase of the lixiviant comprises an aqueous solution containing a conventional surfactant such as that sold under the tradename Dowfax 2A1 by the Dow Chemical Co. (sodium salt of dodecylated oxydibenzene disulphonate), a polyacrylate scale inhibitor such as CALNOX® 214 (Aquaness Chemical Company), ammonium sulfate, and ammonium. Optionally, up to about 100 ppm thiocyanate ion ($SCN^-$) may also be included. This anion has been observed to inhibit an in situ reaction between ammonia and oxygen which unnecessarily depleates both reagents. The choice of whether to use thiocyanate will be an economic one balancing the ammonia and oxygen containing gas cost saving and the current cost of thiocyanate.

Oxygen containing gas bubbles, after being introduced into the aqueous phase by a sparger, are maintained as discrete bubbles in the vicinity of the leaching interval by a device known as an exhauster which effects continuous vertical circulaton of the lixiviant in lower portions of the well bore. The device has an ejection nozzle located in a lower portion of the leaching interval and an aspirator passage inlet located in an upper portion of the leaching interval which recaptures and entrains gas. The cooperative interaction between the sparger and exhauster yields an oxygenated lixiviant or leach liquor containing well dispersed, minute oxygen bubbles. This unique two-phase lixiviant is able to effectively penetrate the fractures of the ore body and effect dissolution of the copper ore due to the minute bubble characteristics of the oxygen phase of the leach solution.

An exemplary steady-state operation is schematically illustrated in the drawing. A lixiviant comprising 0.25 M $(NH_4)_2SO_4$, 1.0 M $NH_3$, 25 ppm DOWFAX® and 75 ppm CALNOX® is mixed with oxygen in a sparger and forced under pressure down an access well and through the leaching interval. In the leaching interval, copper and nickel sulfides are oxidized by oxygen and leached as nickel and copper ammonia complex ions. Some calcium is released. Copper and nickel uptake by metal absorbing minerals is inhibited by the pressence of absorbed ammonium ion and the ammonium ion concentration in the lixiviant. After the pregnant solution is collected from a recovery well, it is treated with lime and stripped of metal values by conventional techniques. Thereafter, the solution is reconstituted and recirculated.

To further discourage absorption of metal values by in situ ion exchange, the lixiviant should have an ammonia concentration no greater than 1.0 M. In this regard, it has surprisingly been discovered that ammonia rich solutions, e.g., 2.5 M $NH_3$ solutions, have an increased tendency to give up copper ions to the clay minerals noted above. Thus the yield of copper from the leaching interval is actually increased if lower ammonia concentrations are used. The reason for this is believed to involve a secondary mechanism of metal absorption on certain biotites which occurs preferentially in the presence of higher $NH_3$ concentrations. To avoid zeolite formation, the pH of the aqueous phase should be maintained below about 10.2.

Termination Stage

When the metal content of the leaching interval has been depleted, the valuable ammonia, copper, nickel or uranium solution remaining in the leaching interval is replaced with a less valuable fluid in order to maximize metal recovery and reduce reagent losses. Any environmentally compatible liquid may be used for this purpose. A 5% brine solution is recommended since this is more effective than process water which tends to dilute the remaining reagents.

Emplacement and Scheduling of Scale Inhibitor

There are three basic techniques by which scale inhibitors are utilized in solution mining:

Meter inhibitor into the produced fluids downhole through the annulus or a spaghetti string. This approach provides maximum flexibility as to inhibitor used and permits maximum control of inhibitor at minimum levels. However, it is undesirable because it provides no scale control in the rock and requires special multihole packers.

Squeeze emplacement into the producing zone. This approach will protect at least the producing zone of the deposit and production equipment and requires no special equipment. However, the polyacrylate scale inhibitors are too weakly sorbed by the rock for this approach to be economic.

EXAMPLE XIV

Squeeze Emplacement

Inhibitor was squeezed into a hundred foot zone in the production hole: 10,000 gallons of ammoniacal solution was injected as a preflush, followed by 7500 gallons of 1 M $NH_3$-1 M $NH_4NO_3$ containing 27 gpl polyacrylate. 15,000 gallons of 1 M $NH_3$-1 M $NH_4NO_3$ was then added as an overflush to push the inhibitor back into the deposit.

Figure 2:
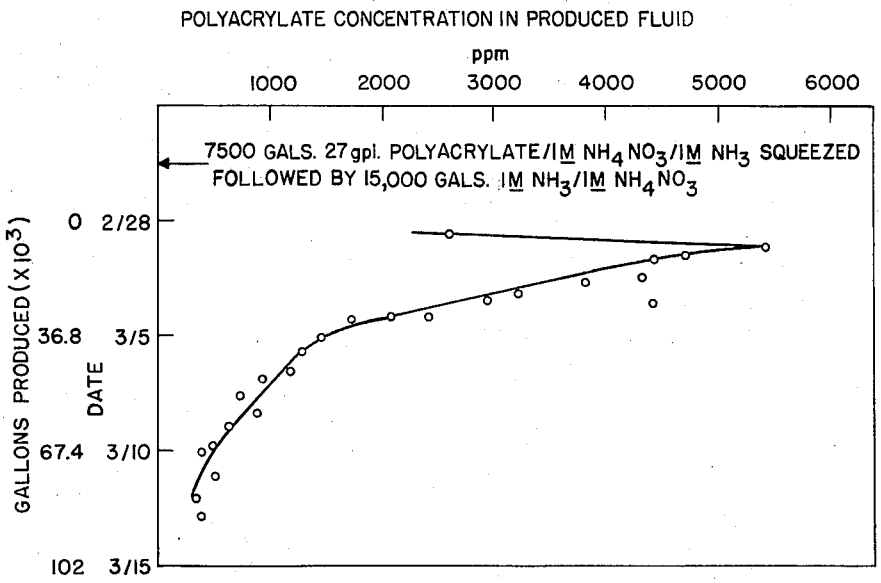
FIG. 2 is a graph showing the effects of a scale inhibitor.

Polyacrylate concentration in the recovered fluid is plotted against time in FIG. 2. Of the 1690 lbs of polyacrylate injected, some 1400 lbs was produced in 18 days. By extrapolation, it was estimated that the inhibitor level would be below 25 ppm after the production of 300,000 gallons of solution.

Addition to the injection fluid. This approach requires that the inhibitor be stable in the lixiviant for long periods of time and that it be but weakly absorbed by the rock forming minerals. This approach has the potential of protecting the injection hole, the bulk of the orebody, the production hole and the production equipment from scale formation. It has been discovered that the polyacrylate inhibitors meet these criteria.

EXAMPLE XV

Stability of Inhibitors

Ammoniacal solutions containing individual phosphonate or polyacrylate scale inhibitors were heated for four weeks at 65° C. and 1000 psi oxygen in the presence of rock fragments to test inhibitor stability. Residual inhibitor effectiveness was assessed by adding aliquots of calcium solution (to supersaturate the treated solutions) and measuring the calcium concentration after 24 hours. Both the polyacrylate and the triethylenediamine penta (methylenephosphonic) acid retained inhibitory powers; less stable phosphonates did not.

EXAMPLE XVI

Stability of Inhibitors

In another series of experiments the polyacrylate and triethylenediamine penta (methylenephosphoric) acid were added at the $5/1000 gallon level to calcium supersaturated solutions containing 0.75 M $NH_3$, 0.25 M $(NH_4)_2SO_4$ and 1.2 gpl Ca; these test solutions were heated for four weeks at 65° C. and 1000 psi $O_2$ in the presence of rock fragments. After treatment, the calcium levels were 1.00 gpl in the phosphonate experiment; 1.04 gpl in the polyacrylate experiment; and 0.57 gpl in a control experiment with no inhibitor. Analysis of the oxidized phosphonate solutions showed the formation of free ortho-phosphate, due to hydrolysis of 70% of the phosphonate groups.

From these tests it was concluded that the polyacrylate is more chemically stable than are the phosphonates.

EXAMPLE XVII

Adsorption of Scale Inhibitors on Rock

The stability experiments suggested that polyacrylate is sufficiently stable to be added to the injected fluids. The field squeeze test described in Example XIV suggested that the polyacrylate was not strongly adsorbed and would pass through the deposit. To confirm this, further experiments were carried out in which ammoniacal solutions of CALNOX® 214 polyacrylate and A915 polyacrylate were equilibrated with rock fragments fractured to expose the vein materials that "see" the lixiviant in-situ. Table XVII shows that the inhibitors were poorly adsorbed, that adsorption did not increase with inhibitor concentration and that adsorption was not a function of polyacrylate molecular weight.

TABLE XVII

Adsorption of Inhibitors on Rock, 65° C.

60 g of ¼ to 1 cm rock fragments were treated with 25 ml of 0.5M $NH_3$, 0.25M $(NH_4)_2SO_4$ for three days

| Inhibitor | Initial Polyacrylate ppm | Final Polyacrylate ppm | Sorbed Polyacrylate lb/ton/rock |
|---|---|---|---|
| CALNOX® 214 | 82 | 79 | 0.003 |
| (Polyacrylate, | 38 | 31 | 0.006 |
| 1000 MW) | 17 | 10 | 0.006 |
| A 915 | 49 | 42 | 0.006 |
| (Polyacrylate, | 23 | 13 | 0.008 |
| 5000 MW) | 11 | 3 | 0.007 |

As a final demonstration of the preferred mode of utilization of the polyacrylate scale inhibitor consider the following example.

EXAMPLE XVIII

Addition of Polyacrylate to Injected Fluids

Figure 3:
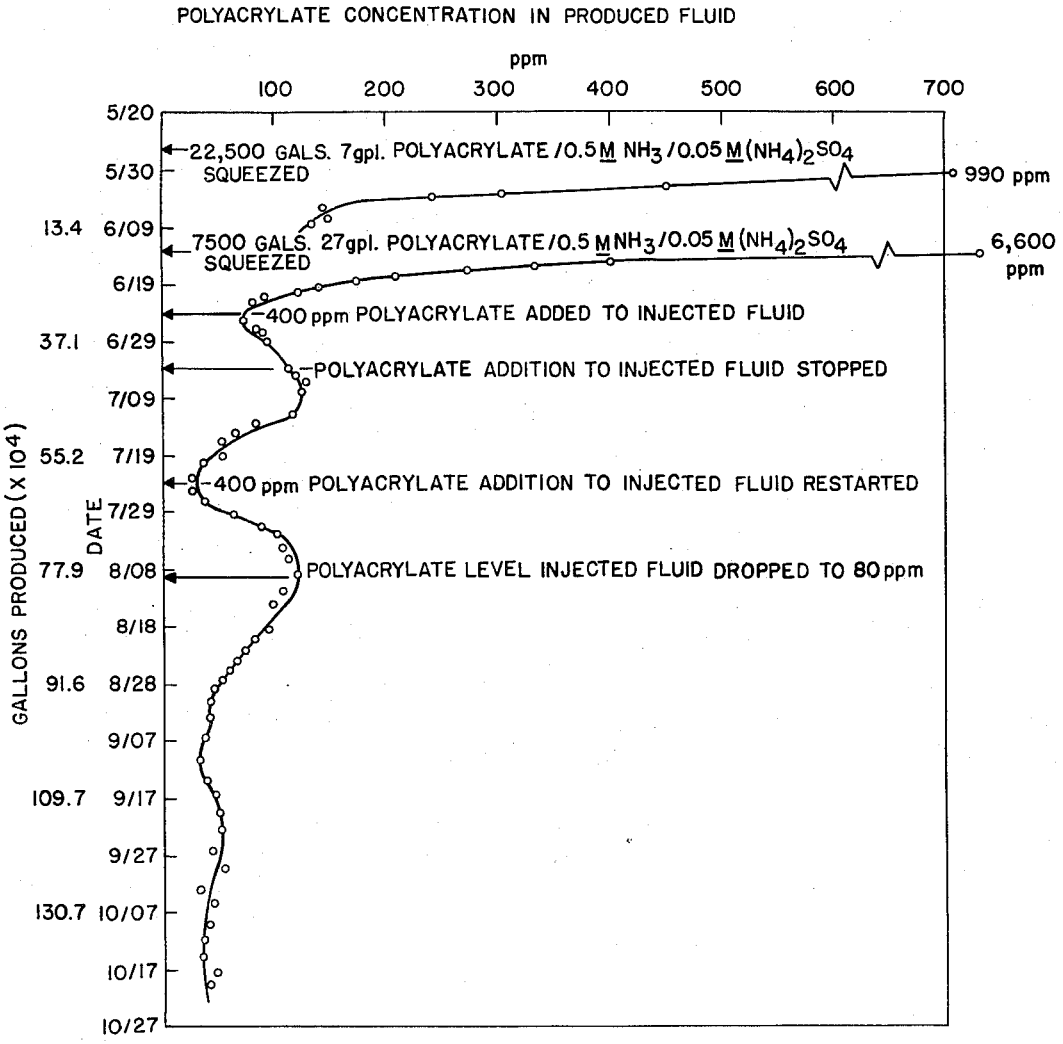
FIG. 3 is another graph showing the effects of a scale inhibitor.

CALNOX® 214 was added to the injected fluids at polyacrylate concentration of around 400 ppm. Polyacrylate levels subsequently rose at the production hole, signifying successful passage of inhibitor; cf. FIG. 3. Due to lack of supply, no polyacrylate was added to the injected fluids July 3–23, and polyacrylate levels at the production hole fell to about 40 ppm. Inhibitor addition to the injected fluids was resumed on July 23; levels started to rise in the produced fluids on July 29 and reached about 120 ppm. On August 6, the inhibitor level in the injected fluid was decreased to around 80 ppm. The result was a stabilization of the polyacrylate level in the produced fluid at around 40 ppm. Clearly, the level of scale inhibitor in the produced fluid can be controlled by adjusting the level in the injected fluid.

Produced fluids were supersaturated with calcium at all stages of the test. Moreover, they were stable over a long period of time at ambient temperature, allowing transportation and storage. The supersaturation could be relieved by treating produced fluid with large amounts of gypsum or calcite to remove polyacrylate.

Based on these examples, it will be clear to those skilled in the art that inhibitor application rates are optimally structured into three phases.

A. Polyacrylate is squeezed into the production holes or added to a preleaching stimulation or tracer fluid with the objective of conditioning the production zone prior to leaching. Addition of inhibitor at a high level to a stimulator or tracer fluid is preferred since it is more economical.

B. Once the inhibitor is observed in the produced fluids, the polyacrylate level in the injected fluids is reduced to maintain a minimum level in the produced fluids. The supersaturated calcium is removed in the surface plant by carbonation, or less desirably by liming, prior to reinjection. Towards the end of this period, the produced fluids will become undersaturated in calcium as the ion exchanger minerals become fully accessed; when this occurs, further polyacrylate addition stops.

C. No inhibitor addition is required so long as the produced fluids remain undersaturated in calcium.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A process for the in situ exploitation of a deep set, porphyry ore deposit of the type characterized by a multiplicity of naturally occurring microscopic fracture openings and containing a metal value selected from the group of sulfidic copper, nickel, cobalt, molybdenum, uranium and mixtures thereof and metals by ion exchange, said process comprising the steps of:

A. providing an injection well and a plurality of production wells spaced apart from the injection well, said wells being in communication with said prophyry ore deposit, the volume between the injection well and the production wells defining leaching interval;

B. stimulating the permeability of the leaching interval by contacting the leaching interval through said injection well with a first aqueous solution comprising ammonia, a calcium sulfate scale inhibitor and an effective amount of nitrate or chloride salt of a cation selected from the group consisting of $Na^+$, $K^+$, $NH^+_4$ and mixtures thereof to replace exchangeable calcium ions, to induce clay concentration, and to solubilize calcium ions;

C. priming the leaching interval by displacing the calcium ion containing solution in the leaching interval with a second aqueous solution containing an ammonium salt, a calcium sulfate scale inhibitor, and oxygen containing gas, the ammonium ion content of the second solution being effective to suppress the uptake on the ion exchange minerals of copper and/or nickel released on oxidation of the sulfidic copper and/or nickel minerals by oxygen;

D. recovering copper and/or nickel by injecting a two-phase lixiviant into the leaching interval, said lixiviant comprising a multiplicity of entrained oxygen containing gas bubbles and an aqueous solution containing scale inhibitor having a pH less than 10.2, containing ammonium ions and containing no greater than about 1.0 mole/liter ammonia, collecting a copper and/or nickel bearing ammoniacal leach liquor from a production well, winning copper and/or nickel from the recovered leach liquor, adding oxygen and make up chemicals to the copper and/or nickel depleted liquor, and recirculating the resulting lixiviant; and E. displacing the solutions in the leaching interval by injecting a filler solution into the leaching interval and collecting a copper and/or nickel bearing ammoniacal liquor from a production well.

2. The process as set forth in claim 1 wherein the scale inhibitor is a polyacrylate with a molecular weight of 250–10,000 and an equivalent weight of less than 150.

3. The process as set forth in claim 1 wherein the leaching interval contains a zeolite, and during said priming stage, the ammonium ion concentration in the second solution is maintained above about 0.5 M.

4. The process as set forth in claim 1 wherein said first solution comprises ammonium nitrate in a concentration of at least about two moles per liter, said solution further comprising a calcium sulfate scale inhibitor.

5. The process as set forth in claim 1 wherein ammonium ion is used in step B, and in step C, a calcium ion containing solution is collected from a production well, calcium is precipitated from said solution, and the remaining, calciumdepleted solution is reinjected.

6. The process as set forth in claim 1 where sufficient scale inhibitor is added to the injection solution to maintain the scale inhibitor concentration in the produced solution within the range of 5–50 ppm so long as the produced fluids are supersaturated in calcium.

* * * * *